United States Patent [19]

Zimmer

[11] Patent Number: 4,557,194

[45] Date of Patent: Dec. 10, 1985

[54] ROTARY-SCREEN PRINTER WITH MAGNETICALLY ATTRACTED WIPER

[76] Inventor: Johannes Zimmer, Ebentaler Strasse 133, 9020 Klagenfurt, Austria

[21] Appl. No.: 614,412

[22] Filed: May 25, 1984

[30] Foreign Application Priority Data

May 25, 1983 [AT] Austria ..... 1900/83

[51] Int. Cl.[4] ..... B41L 13/06

[52] U.S. Cl. ..... 101/120; 101/124

[58] Field of Search ..... 101/114, 116, 119, 120, 101/121, 122, 123, 124, 126

[56] References Cited

U.S. PATENT DOCUMENTS

| | | | |
|---|---|---|---|
| 3,592,132 | 7/1968 | Weber | 101/119 |
| 3,902,414 | 9/1975 | Zimmer | 101/116 |
| 3,919,973 | 4/1974 | Zimmer | 101/122 |
| 4,090,443 | 5/1978 | Gasser | 101/123 |

FOREIGN PATENT DOCUMENTS

| | | | |
|---|---|---|---|
| 0081476 | 6/1983 | European Pat. Off. | 101/120 |
| 2101085 | 10/1971 | Fed. Rep. of Germany | 101/120 |
| 2405108 | 9/1974 | Fed. Rep. of Germany | 101/120 |
| 2321948 | 3/1977 | France | 101/120 |
| 571952 | 1/1976 | Switzerland | 101/120 |

*Primary Examiner*—Clyde I. Coughenour
*Assistant Examiner*—William L. Klima
*Attorney, Agent, or Firm*—Karl F. Ross; Herbert Dubno

[57] ABSTRACT

The nadir of a cylindrical printing screen rotatable about a horizontal axis is pressed against an underlying substrate, moving over a flat support, by a wiper in the form of a roller or a blade which is attracted by a bank of electromagnets having pole faces flush with the upper surface of the support. The line of contact between the screen and the substrate, determined by the location of the wiper inside the screen, is offset in the direction of substrate motion from a common midplane of the underlying pole faces; the extent of this offset, designed to stabilize the position of the wiper, is adjustable to accommodate substrates of different thicknesses.

10 Claims, 5 Drawing Figures

ROTARY-SCREEN PRINTER WITH MAGNETICALLY ATTRACTED WIPER

FIELD OF THE INVENTION

My present invention relates to a printing apparatus of the type provided with a cylindrical screen that rotates about a horizontal axis and has a pattern of dyestuff-permeable perforations through which an underlying substrate, moving tangentially with the screen on a supporting surface of a worktable or the like, is imprinted.

BACKGROUND OF THE INVENTION

In such a printer it is known to provide the rotating screen with an internal mobile wiper which, under its own weight supplemented by magnetic attraction, bears upon the lowest point or nadir of the screen circumference to establish a line of contact with the substrate. The attractive force is generally provided by a bank of magnets disposed in or below the worktable, the upright cores of those magnets having aligned pole faces which are flush with the upper table surface and are bisected by a common midplane paralleling the axis of rotation.

Curved blades or slot wipers, weighted by masses of magnetizable material such as soft-iron plates or bars, may be used in such a printer for holding down the screen and forcing the dyestuff through its perforations. Frequently, however, the wiper is designed as a magnetizable roller which rotates on the inner peripheral surface of the turning screen. Conventional wisdom places the screen axis in the vertical midplane of the pole faces in the expectation that this will hold the roller directly above the nadir for the production of sharp prints. In practice, however, it has been found that a roller so positioned has a tendency to wander over the area of the pole faces, in the direction of screen rotation, so that its own centerline no longer lies in the axial vertical plane of the screen and may even become oriented skew to the line of contact. These excursions of the roller, taking place during operation, may cause varying accumulations of dyestuff above the line of contact and, since the dyestuff no longer penetrates the screen at its nadir, result in a blurred and irregular print. Presumably, the described phenomenon is essentially due to the fact that the magnetic force acting upon the roller—or, for that matter, on any other sort of wiper—does not vary significantly over the pole-face area and thus does not constrain the wiper to remain centered with reference thereto. A larger gradient of that force, with a greater restraining effect, exists at the downstream boundary of the area toward which the roller tends to migrate. I have found that the extent of this migration depends mainly on the ratio between the roller diameter and the width of the pole-face area, this ratio being generally a fixed parameter, and on the variable thickness of the substrate to be imprinted.

OBJECT OF THE INVENTION

It is, therefore, the object of my present invention to provide means in a screen printer of the type described for obviating the detrimental effects of excursions of a magnetically attracted wiper.

SUMMARY OF THE INVENTION

I realize this object, in accordance with my present invention, by making the screen displaceable relatively to the bank of magnets, in the direction of screen rotation, for separating its line of contact from the midplane of the pole faces by a distance which stabilizes the position of the magnetically attracted wiper.

Although my invention primarily applies to magnetizable rollers, it is also useful in conjunction with other types of wipers whose position is unstable when the mass center of their magnetizable parts lies directly above the pole-face area.

With a given rotary-screen printer the optimum offset between the line of contact and the midplane of the pole faces can be empirically determined for different substrate thicknesses so as to enable a preliminary adjustment before printing is begun. As a general rule, a roller whose diameter is substantially smaller than the width of the pole-face area will be stabilized in a position close to the downstream boundary of that area whereas a roller of larger relative diameter will come to rest farther downstream. I have further observed that a sloping plane defined by the centerline of the stabilized roller and the line of intersection between the supporting surface and the midplane of the pole faces will usually be inclined to the horizontal at an angle ranging between about 30° and 60°.

BRIEF DESCRIPTION OF THE DRAWING

The above and other features of my invention will now be described in detail with reference to the accompanying drawing in which.

SPECIFIC DESCRIPTION

Figure 1:
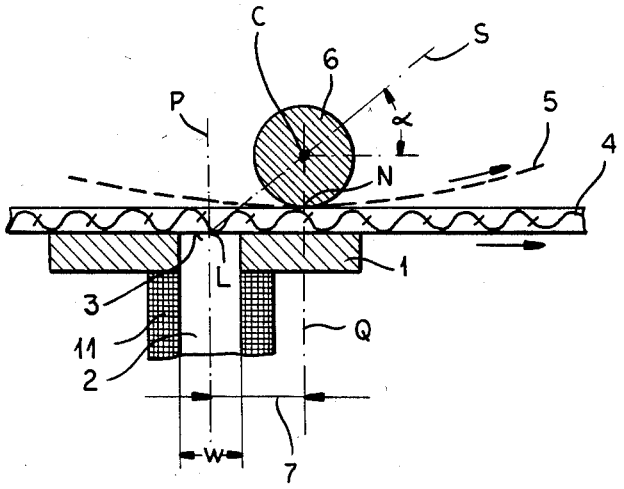
FIG. 1 is a cross-sectional view of the lower part of a screen printer embodying my invention, having a roller-type wiper of large diameter relative to the pole-face area of an associated bank of magnets.

As illustrated in FIG. 1, a worktable 1 has an upper surface supporting a substrate 4 to be imprinted, e.g. a relatively thick web of fabric or the like. A cylindrical printing screen 5, whose perforated peripheral wall acts as a pattern or mask, rotates counterclockwise above the table 1 as the substrate 4 moves at the peripheral speed of the screen from left to right. A bank of electromagnets with upright cores 2 surrounded by windings 11, of which only one is shown in this view, have pole faces 3 (cf. FIG. 4) flush with the upper surface of table 1 which define an area of width w bisected by a vertical midplane P crossing the upper table surface at a line L. A wiper 6 in the form of a magnetizable roller, whose diameter substantially exceeds the width w of the pole-face area, has a centerline C in a vertical contact plane Q passing through the nadir N of screen 5. Plane Q is offset, for the reasons explained above, from plane P in the direction of screen rotation by a distance 7 which in this instance roughly equals the diameter of roller 6. It will also be noted that a sloping plane S, passing through the line of intersection L and the centerline C, includes with the horizontal an acute angle $\alpha$ lying within the aforementioned range of about 30° to 60°.

In this optimum position, roller 6 is stabilized and does not tend to migrate as the screen 5 rotates and dyestuff is pressed through its perforations by the corotating roller along the line of contact coinciding with nadir N. If the substrate 4 were replaced by one of different thickness, the optimum roller position represented by plane Q would change but the angle $\alpha$ would still remain in the aforementioned range.

Figure 2:
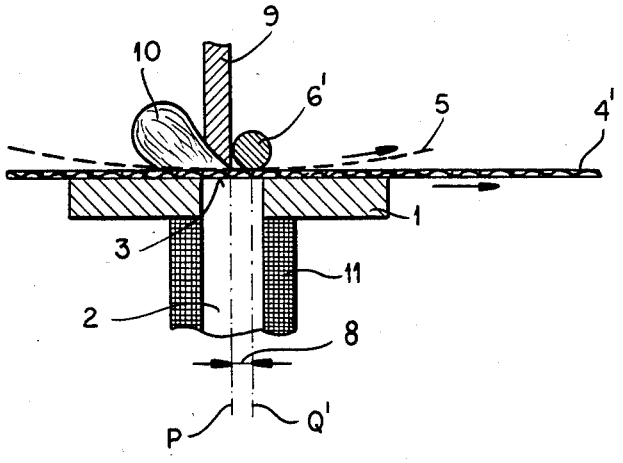
FIG. 2 is a view similar to FIG. 1 but with a wiper whose diameter is small compared with the width of the pole-face area.

FIG. 2 shows a similar assembly of a worktable 1 with a bank of electromagnets 2, 11 having pole faces 3, including a wiping roller 6' of substantially smaller diameter than roller 6 of FIG. 1. A vertical plane Q', passing through the centerline of roller 6' and through the line of contact between screen 5 and an underlying substrate 4', intersects the area of pole faces 3 but lies within the downstream boundary of that area; roller 6' still projects beyond that boundary. The width of the pole-face area, which is the same as in FIG. 1, is almost twice the diameter of roller 6' which is seen to adjoin a doctor blade 9 fixedly disposed on its downstream side; a working edge of blade 9, here shown to lie in midplane P, is spaced by a small gap from the inner surface of screen 5 to let a controlled amount of dyestuff 10 pass to the line of contact between the screen and the substrate 4' which in this instance is much thinner than substrate 4 of FIG. 1.

In the assembly of FIG. 2, a sloping plane corresponding to that shown at S in FIG. 1 includes with the horizontal an acute angle somewhat less than 60°.

Figure 3:
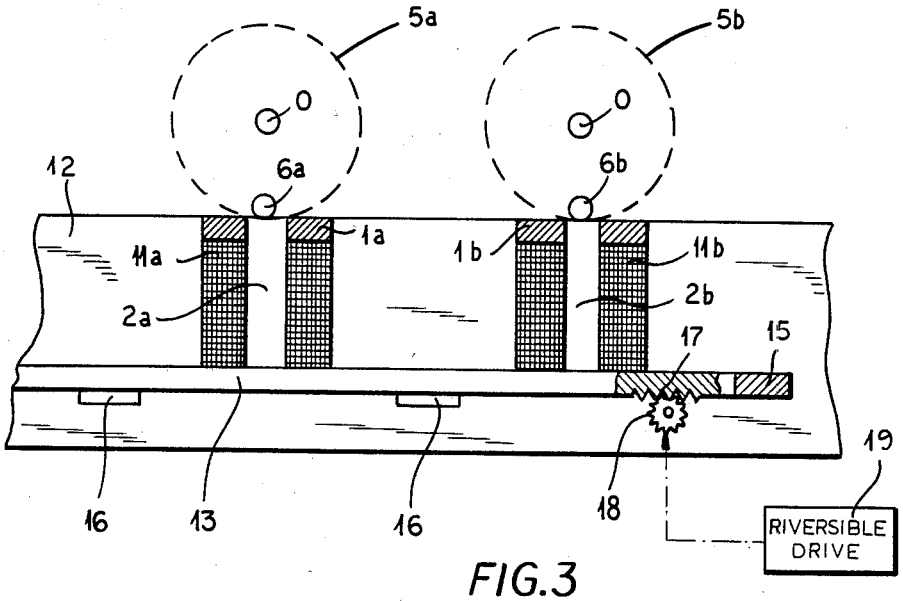
FIG. 3 is a cross-sectional view, drawn to a smaller scale, of an apparatus according to my invention with two screens overlying respective magnet banks.
Figure 4:
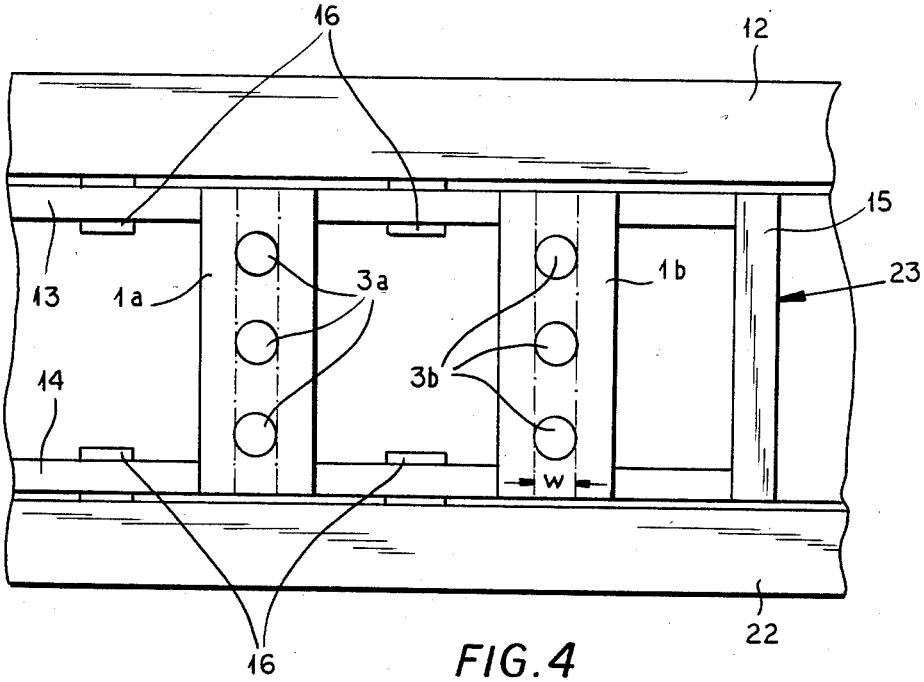
FIG. 4 is a top view of the structure of FIG. 3 but with the screens omitted.

In FIGS. 3 and 4 I have shown part of a more elaborate printing apparatus comprising a base with two parallel walls 12, 22 between which a frame 23 is limitedly shiftable in a plane perpendicular to the axes of rotation O of two cylindrical screens **5*a* and 5*b* disposed just above that base. The screens are shown to be of identical diameters but may be provided with different patterns of perforations for printing respective color components on an underlying substrate which has not been illustrated. The substrate is to be supported by worktables 1*a* and 1*b* whose upper surfaces, on the level of the top edges of walls 12 and 22, are flush with pole faces 3*a* and 3*b* of respective magnet cores 2*a* and 2*b* provided with windings 11*a* and 11*b*. Pole faces 3*a* and 3*b* again define respective areas of width w which in this instance also exceeds the diameter of the mutually identical magnetizable rollers 6*a* and 6*b***.

The bank of magnets **2*a*, 11*a* and 2*b*, 11*b* form prismatic blocks, registering with tables 1*a* and 1*b*, which are supported at opposite ends by longitudinal bars 13 and 14 of frame 23 that are slidably carried on lugs 16 projecting inward from walls 12 and 22. Bars 13 and 14 are interconnected by cross-pieces 15 of which only one has been illustrated. On their undersides, as particularly shown for bar 13 in FIG. 3, each of these bars is provided with a set of rack teeth 17 engaged by a respective pinion 18 which can be turned in one or the other direction by a reversible driving unit 19 to offset the midplanes of pole faces 3*a* and 3*b* from the lines of contact between screens 5*a*, 5*b* and the underlying substrate. As will be understood from the preceding description, the sense of the offset depends on the direction of rotation of screens 5*a* and 5*b* whose axes are separated from each other by the same distance as the midplanes of pole faces 3*a* and 3*b*. Naturally, more than two screens and associated worktables with magnet banks can be provided in the apparatus of FIGS. 3 and 4**; the several worktables could also be combined into a unitary support.

Figure 5:
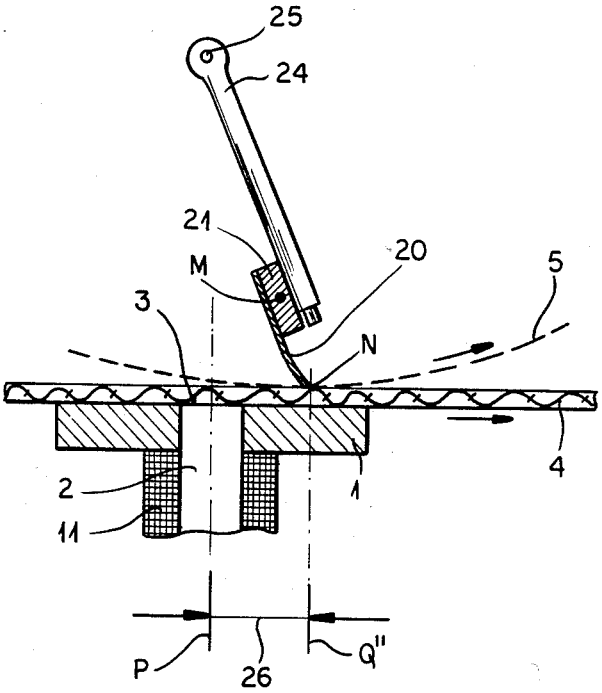
FIG. 5 is a fragmentary cross-sectional view, generally similar to FIGS. 1 and 2, showing part of a screen provided with a blade-type wiper.

In FIG. 5 I have shown part of another printer according to my invention whose cylindrical screen 5 is wiped by a curved blade 20 facing with its concave side in the direction of rotation. Blade 20 is fastened to a soft-iron bar 21 carried by one or more arms 24 which are swingable in a transverse plane of the screen about a pivotal axis 25. A substrate 4'' to be imprinted, moving at the peripheral speed of screen 5 on a worktable 1 again provided with a bank of electromagnets 2, 11 having pole faces 3, is engaged by the screen at its nadir N along a line of contact which lies in a vertical plane Q'' offset by a distance 26 from the midplane P of pole faces 3. The magnetically permeable bar 21 has a mass center M on a sloping plane, including the line of intersection between plane P and the upper table surface, which again is inclined in a range of about 30° to 60° as mentioned above.

The offset 26, which also in this instance is a function of substrate thickness, stabilizes the position of blade 20 to prevent it from oscillating about pivotal axis 25 and to insure the obtention of sharp prints on the substrate. Contact plane Q'' lies in this Figure well beyond the downstream boundary of the area of pole faces 3.

I claim:

1. In a printing apparatus wherein a cylindrical screen rotatable about a horizontal axis has a pattern of dyestuff-permeable perforations and touches a substrate, movable tangentially with the screen on an upper surface of an underlying support, along a line of contact determined by a mobile mass including a magnetically attracted wiper bearing upon the inner peripheral screen surface for forcing dyestuff through said perforations onto the substrate, said mass being at least partly magnetizable and being attracted toward the substrate by a bank of upright magnets having aligned pole faces flush with said upper surface bisected by a common midplane paralleling said axis, the improvement wherein said screen is displaceable relatively to said bank of magnets in the direction of rotation for separating said line of contact from said midplane by a distance stabilizing the position of the magnetically attracted wiper.

2. An apparatus as defined in claim 1 wherein said wiper is a magnetizable roller projecting at least partly beyond the area of said pole faces in said direction of rotation.

3. An apparatus as defined in claim 2 wherein said roller has a centerline lying substantially in a vertical axial plane of said screen, a line of intersection of said midplane with said upper surface defining with said centerline a sloping plane inclined to the horizontal at an angle between about 30° and 60° in a range of adjustment of said distance.

4. An apparatus as defined in claim 3, further comprising a doctor blade preceding said roller in said direction of rotation with a small spacing from the inner peripheral screen surface.

5. An apparatus as defined in claim 2 wherein said roller has a diameter substantially smaller than the width of said pole faces in said direction of rotation, said vertical axial plane lying close to a downstream boundary of the area of said pole faces.

6. An apparatus as defined in claim 1 wherein said mass comprises a magnetizable horizontal bar on a holder which is swingable in a radial plane of said screen, said wiper being a curved blade mounted on said holder with a concave side facing in said direction of rotation.

7. In a printing apparatus wherein a cylindrical screen rotatable about a horizontal axis has a pattern of dyestuff-permeable perforations and touches a substrate, movable tangentially with the screen on an upper surface of an underlying support, along a line of contact determined by a mobile mass including a wiper bearing upon the inner peripheral screen surface for forcing dyestuff through said perforations onto the substrate, said mass being at least partly magnetizable and being attracted toward the substrate by a bank of upright magnets having aligned pole faces flush with said upper surface bisected by a common midplane paralleling said axis, the combination therewith of drive means for bidirectionally shifting said bank of magnets relatively to said screen in a plane perpendicular to said axis into a position in which said line of contact is separated from said midplane, in the direction of rotation, by a distance stabilizing the position of the magnetically attracted wiper.

8. The combination defined in claim 7 wherein said screen is one of a plurality of screens codirectionally rotatable about parallel axes, said bank of magnets being one of a plurality of magnet banks respectively disposed below said screens and mounted on a common frame shiftable by said drive means, each of said screens being provided with a respective wiper defining a line of contact thereof with the underlying substrate, the spacing of said parallel axes equaling the spacing of the midplanes of said magnet banks from one another.

9. The combination defined in claim 8 wherein the wipers of said screens are magnetizable rollers of identical diameters.

10. The combination defined in claim 8 wherein said frame is provided with rack teeth, said drive means including a pinion in mesh with said rack teeth.

* * * * *